US010177474B2

(12) United States Patent
Yang et al.

(10) Patent No.: US 10,177,474 B2
(45) Date of Patent: Jan. 8, 2019

(54) CONNECTOR AND CONNECTOR ASSEMBLY

(71) Applicant: Tyco Electronics (Shanghai) Co. Ltd., Shanghai (CN)

(72) Inventors: Hongwen Yang, Shanghai (CN); Hongqiang Han, Shanghai (CN); Wenyu Liu, Shanghai (CN); Jiwang Jin, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 15/715,251

(22) Filed: Sep. 26, 2017

(65) Prior Publication Data

US 2018/0090863 A1 Mar. 29, 2018

(30) Foreign Application Priority Data

Sep. 26, 2016 (CN) ..... 2016 1 0851207

(51) Int. Cl.

| | |
|---|---|
| ***H01R 12/71*** | (2011.01) |
| ***H01R 13/502*** | (2006.01) |
| ***H01R 12/70*** | (2011.01) |
| ***H01R 13/6594*** | (2011.01) |

(52) U.S. Cl.

CPC ..... *H01R 12/716* (2013.01); *H01R 12/7005* (2013.01); *H01R 12/707* (2013.01); *H01R 13/502* (2013.01); *H01R 13/6594* (2013.01); *H01R 2201/06* (2013.01)

(58) Field of Classification Search

CPC ..... H01R 13/658; H01R 13/6581; H01R 13/6586; H01R 13/6587; H01R 13/6588; H01R 13/659; H01R 13/65802; H01R 23/6873; H05K 9/0058

USPC ..... 439/607.21, 607.27, 607.35, 607.25, 439/607.09

See application file for complete search history.

(56) References Cited

U.S. PATENT DOCUMENTS

| | | | | |
|---|---|---|---|---|
| 5,941,725 | A * | 8/1999 | Brennan | H01R 13/6275 439/357 |
| 6,264,504 | B1 * | 7/2001 | Wu | H01R 13/6594 439/607.27 |
| 6,729,905 | B1 * | 5/2004 | Hwang | H05K 9/0058 439/607.21 |
| 8,182,290 | B2 * | 5/2012 | Fonteneau | H05K 9/0058 439/607.21 |
| 8,262,414 | B1 * | 9/2012 | Li | H01R 13/6273 439/607.35 |
| 8,426,751 | B2 * | 4/2013 | Lee | H01R 13/506 174/520 |
| 8,979,584 | B2 * | 3/2015 | Tsuchiya | H01R 12/724 439/607.27 |
| 8,992,254 | B2 * | 3/2015 | Banakis | H01R 12/721 439/607.23 |

(Continued)

*Primary Examiner* — Gary F Paumen
(74) *Attorney, Agent, or Firm* — Barley Snyder

(57) ABSTRACT

A connector comprises a cage and a top cover. The cage has a lower portion received in an opening of a circuit board in an insertion direction. A thickness of the lower portion in the insertion direction is disposed in the opening in an assembled position. The top cover is attached to an outer wall of the cage and has a plurality of pins. The pins are inserted in the insertion direction into a plurality of insertion holes extending through the circuit board around the opening in the assembled position.

15 Claims, 4 Drawing Sheets

(56) References Cited

U.S. PATENT DOCUMENTS

| | | | | |
|---|---|---|---|---|
| 9,583,888 | B2 * | 2/2017 | Yang | H01R 13/659 |
| 2002/0094721 | A1 * | 7/2002 | Schulz | H05K 3/301 439/607.35 |
| 2003/0104725 | A1 * | 6/2003 | Kerlin | H05K 9/0058 439/607.27 |
| 2007/0149054 | A1 * | 6/2007 | Watanabe | H01R 13/6582 439/607.27 |
| 2009/0209130 | A1 * | 8/2009 | Kameyama | H01R 23/6873 439/607.27 |
| 2011/0256766 | A1 * | 10/2011 | Chiang | H01R 13/6595 439/607.27 |
| 2015/0255905 | A1 * | 9/2015 | Little | H01R 13/6658 439/78 |
| 2015/0364869 | A1 * | 12/2015 | Yang | H01R 13/659 439/607.25 |
| 2015/0364870 | A1 * | 12/2015 | Yang | H01R 13/659 439/607.25 |

* cited by examiner

CONNECTOR AND CONNECTOR ASSEMBLY

CROSS-REFERENCE TO RELATED APPLICATION

This application claims the benefit of the filing date under 35 U.S.C. § 119(a)-(d) of Chinese Patent Application No. 201610851207.9, filed on Sep. 26, 2016.

FIELD OF THE INVENTION

The present invention relates to a connector and, more particularly, to a connector mounted on a circuit board.

BACKGROUND

Applications of modern high speed input-output (IO) connectors impose increasing requirements on signal transmission rate, installation density, and heat dispersion. Known high speed IO connectors include a cage or housing and a plurality of conductive terminals disposed in the cage. A plurality of pins is disposed on the bottom of the cage and directly inserted into holes formed in the surface of a circuit board. The conductive terminals are soldered to the surface of the circuit board.

Known high speed IO connectors are generally only directly mounted on the surface of the circuit board in the manner described above, however, such a mounting of the high speed IO connector occupies a lager installation space, reducing the installation density of the high speed IO connectors.

SUMMARY

A connector according to the invention comprises a cage and a top cover. The cage has a lower portion received in an opening of a circuit board in an insertion direction. A thickness of the lower portion in the insertion direction is disposed in the opening in an assembled position. The top cover is attached to an outer wall of the cage and has a plurality of pins. The pins are inserted in the insertion direction into a plurality of insertion holes extending through the circuit board around the opening in the assembled position.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
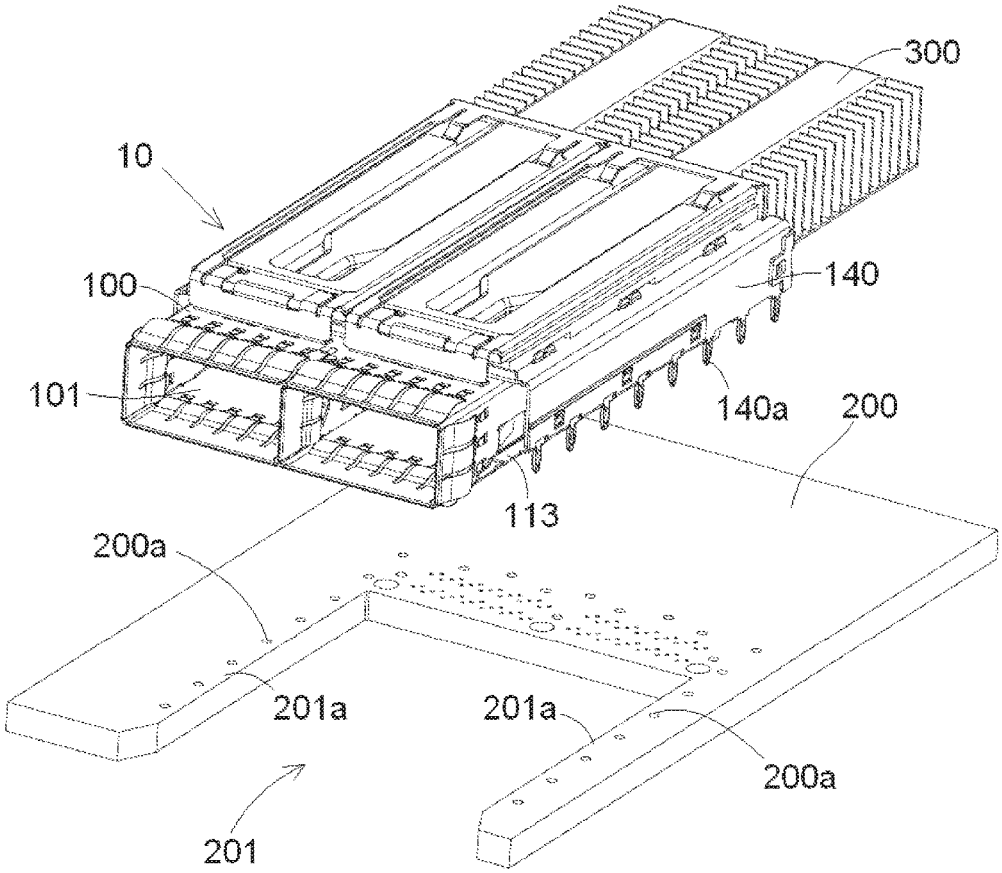
FIG. 1 is an exploded perspective view of a connector assembly according to the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

A connector assembly according to the invention is shown in FIGS. 1-5. The connector assembly includes a connector 10 and a circuit board 200. The major components of the invention will now be described in greater detail.

Figure 2:
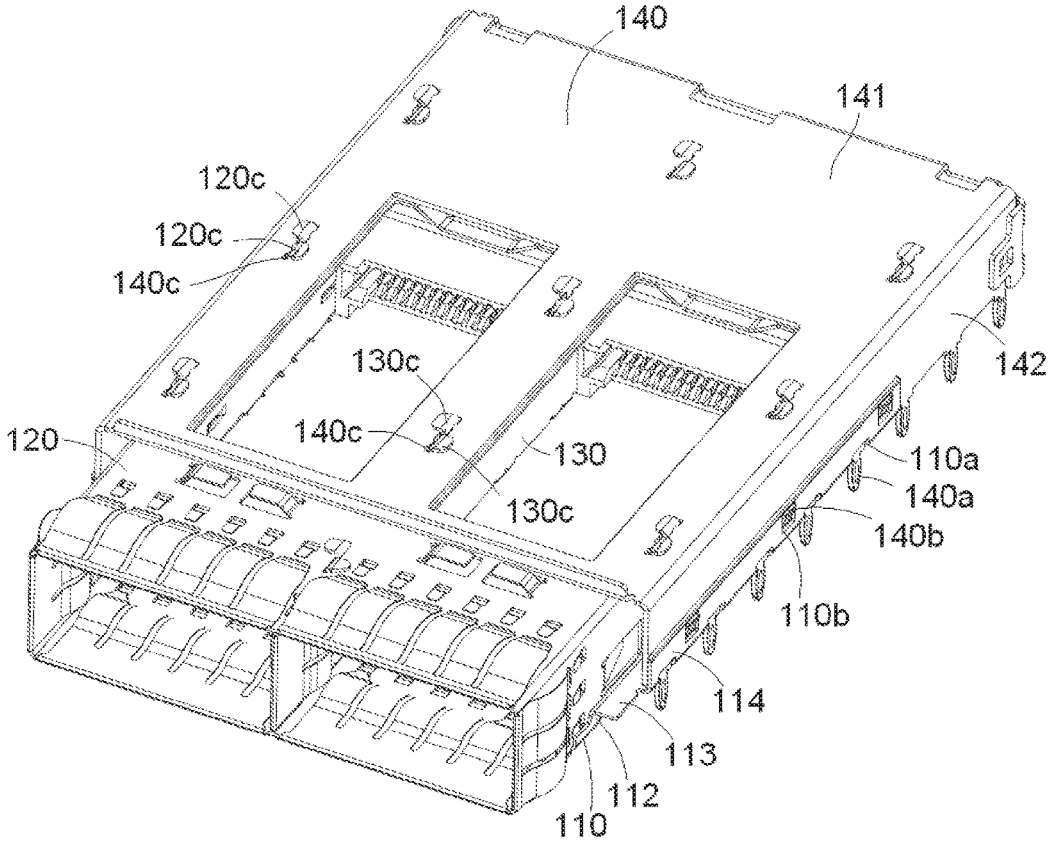
FIG. 2 is a perspective view of a connector of the connector assembly.
Figure 3:
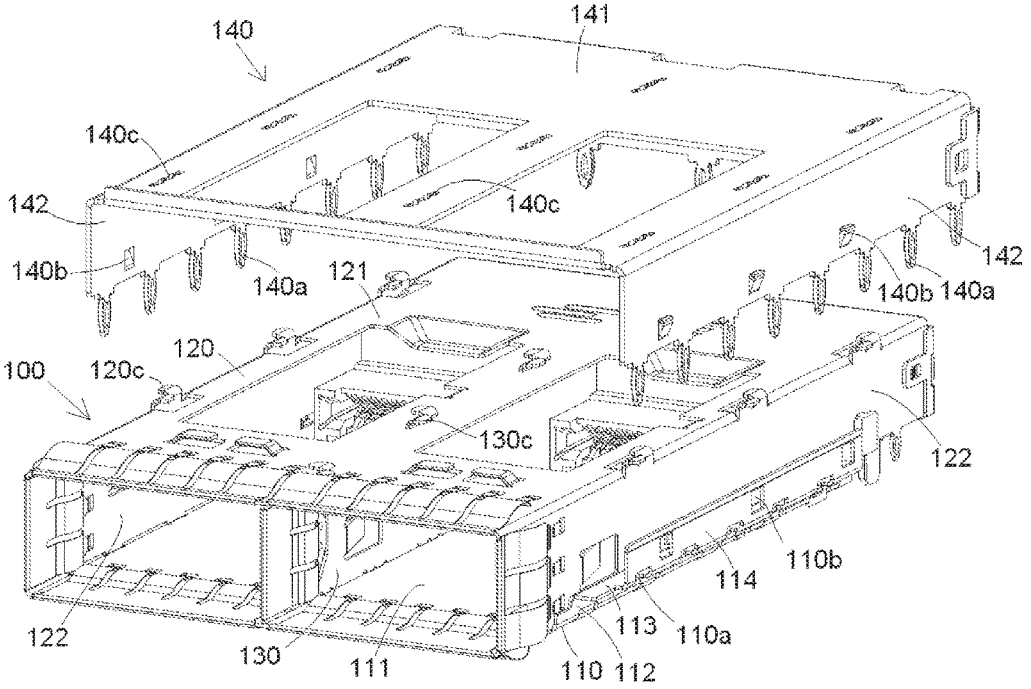
FIG. 3 is an exploded perspective view of the connector.

The connector 10, as shown in FIGS. 1-3, comprises a cage 100 and a top cover 140. The cage 100 includes a bottom cage 110, a top cage 120 opposite the bottom cage 110, and a partition plate 130.

The bottom cage 110, as shown in FIGS. 2 and 3, includes a bottom plate portion 111 formed as a bottom wall of the cage 100, a pair of first vertical side plate portions 112 extending upwardly from both sides of the bottom plate portion 111, a pair of horizontal side plate portions 113 extending horizontally and outwardly from the pair of first vertical side plate portions 112, and a pair of second vertical side plate portions 114 extending upwardly from the pair of horizontal side plate portions 113. A plurality of slots 110*a* are formed at a corner connection between the horizontal side plate portions 113 and the second vertical side plate portions 114. A plurality of grooves 110*b* are formed on the second vertical side plate portions 114.

The top cage 120, as shown in FIGS. 2 and 3, includes a top plate portion 121 formed as a top wall of the cage 100 and a pair of side plate portions 122 extending downwardly from both sides of the top plate portion 121 to form a pair of side walls of the cage 100. A plurality of pairs of first tabs 120*c* are formed on the top plate portion 121 of the top cage 120.

The partition plate 130, as shown in FIGS. 1-3, is disposed between the bottom cage 110 and the top cage 120 and constructed to divide space between the bottom cage 110 and the top cage 120 into two ports 101. A plurality of pairs of second tabs 130*c* are formed on an upper side of the partition plate 130.

The top cover 140, as shown in FIGS. 2 and 3, includes a top plate 141 and a pair of side plates 142 extending downwardly from both sides of the top plate 141. A plurality of pins 140*a* are formed on the lower edge of the side plates 142 and extend downwardly, a plurality of protrusions 140*b* are formed on the side plates 142, and a plurality of connecting slots 140*c* are formed on the top plate 141.

The top cover 140 is attached to the cage 100 as shown in FIGS. 2 and 3. The pins 140*a* pass through the slots 110*a* and the protrusions 140*b* on the side plates 142 are adapted to snap into and engage the grooves 110*b* on the second vertical side plate portions 114 to attach the top cover 140 to the outer wall of the cage 110. Each pair of first tabs 120*c* of the top cage 120 passes through a corresponding connecting slot 140*c* and is folded in opposite directions such that the top plate 141 of the top cover 140 is mounted on the top plate portion 121 of the top cage 120. Each pair of second tabs 130*c* of the partition plate 130 passes through a corresponding connecting slot 140*c* of the top cover 140 and is folded in opposite directions.

Figure 4:
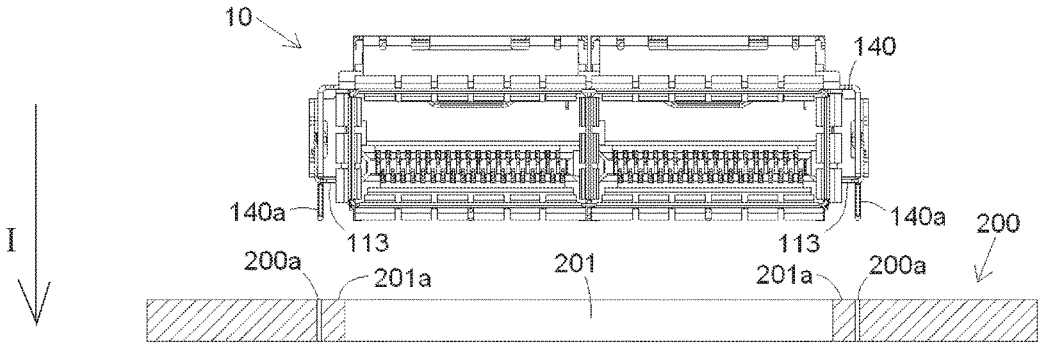
FIG. 4 is a front view of the connector and a circuit board of the connector assembly in a pre-mounted position.
Figure 5:
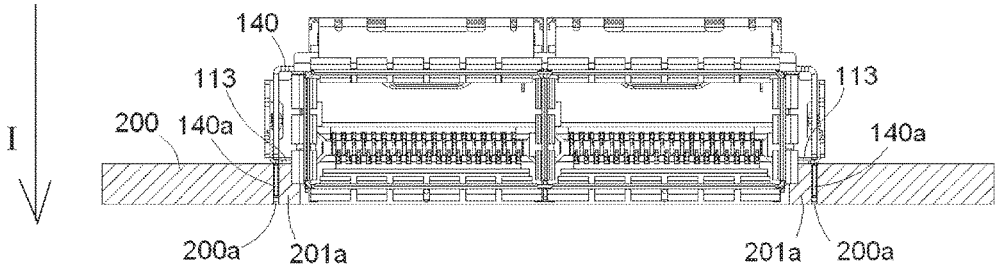
FIG. 5 is a front view of the connector and the circuit board in a mounted position.

The connector 10 is mountable on the circuit board 200, as shown in FIGS. 1, 4 and 5, to form the connector assembly. The circuit plate 200, as shown in FIG. 1, has an opening 201 defined by edge portions 201*a* and a plurality of insertion holes 200*a* extending through the circuit board 200 around the opening 201.

The connector 10 is adapted to be mounted at and sunk in the opening 201 of the circuit board 200. A lower portion of the cage 100 is received in the opening 201 of the circuit board 200 in an insertion direction I and the plurality of pins 140*a* extending downwardly from the top cover 140 are inserted into the insertion holes 200*a* in the insertion direction I. A thickness of the lower portion of the cage 100 is disposed in the opening 201 of the circuit board 200 in an assembled position of the connector 10 and the circuit board 200 shown in FIG. 5, so that the entire thickness of the connector 10 and assembled circuit board 200 is reduced, increasing the potential installation density of the connector 10. Each pin 140*a* is formed with a fish eye hole, so that the pin 140*a* may be elastically shrunk when inserted into the insertion hole 200*a* and reliably held in the insertion hole 200*a*. The horizontal side plate portions 113 of the cage 100 abut the edge portions 201*a* in the assembled position so that the cage 100 is positioned on the circuit board 200 by the horizontal side plate portions 113 and the pins 140*a*. A plurality of end modules 300 may be inserted into the ports 101 of the cage 100, as shown in FIG. 1.

What is claimed is:

1. A connector, comprising:

a cage having a lower portion received in an opening of a circuit board in an insertion direction, a thickness of the lower portion in the insertion direction is disposed in the opening in an assembled position, the cage including a bottom cage and a top cage assembled to each other, the bottom cage having:

a bottom plate portion forming a bottom wall of the cage;

a pair of first vertical side plate portions extending in the insertion direction from a pair of opposite sides of the bottom plate portion;

a pair of horizontal side plate portions extending in a horizontal direction perpendicular to the insertion direction from the first vertical side plate portions, the horizontal side plate portions abut an edge portion of the circuit board in the assembled position; and a pair of second vertical side plate portions extending in the insertion direction from the horizontal side plate portions; and a top cover attached to an outer wall of the cage and having a plurality of pins, the pins inserted in the insertion direction into a plurality of insertion holes extending through the circuit board around the opening in the assembled position.

2. The connector of claim 1, wherein the top cover has a top plate and a pair of side plates extending in the insertion direction from a pair of opposite sides of the top plate.

3. The connector of claim 2, wherein the side plates of the top cover have a plurality of protrusions and the second vertical side plate portions of the bottom cage have a plurality of grooves.

4. The connector of claim 3, wherein the protrusions engage the grooves when the top cover is attached to the outer wall of the cage.

5. The connector of claim 2, wherein the pins are disposed on a lower edge of the side plates of the top cover and extend in the insertion direction.

6. The connector of claim 5, wherein the bottom cage has a plurality of slots disposed at a corner connection between the horizontal side plate portions and the second vertical side plate portions.

7. The connector of claim 6, wherein the pins extend through the slots in the assembled position.

8. The connector of claim 2, wherein the top cage has:

a top plate portion forming a top wall of the cage; and a pair of side plate portions forming a pair of side walls of the cage and extending in the insertion direction from a pair of opposite sides of the top plate portion.

9. The connector of claim 8, wherein the top plate portion of the top cage has a plurality of first tabs.

10. The connector of claim 9, wherein the top plate of the top cover has a plurality of connecting slots.

11. The connector of claim 10, wherein each first tab extends through one connecting slot to mount the top plate of the top cover on the top plate portion of the top cage.

12. The connector of claim 11, wherein the cage has a partition plate disposed between the bottom cage and the top cage dividing a space between the bottom cage and the top cage into a plurality of ports.

13. The connector of claim 12, wherein the partition plate has a plurality of second tabs disposed on an upper side of the partition plate.

14. The connector of claim 13, wherein each second tab extends through one connecting slot.

15. A connector assembly, comprising:

a circuit board having an opening and a plurality of insertion holes extending through the circuit board around the opening; and a connector including:

a cage having a lower portion received in the opening in an insertion direction, a thickness of the lower portion in the insertion direction is disposed in the opening in an assembled position, the cage including a bottom cage and a top cage assembled to each other, the bottom cage having:

a bottom plate portion forming a bottom wall of the cage;

a pair of first vertical side plate portions extending in the insertion direction from a pair of opposite sides of the bottom plate portion;

a pair of horizontal side plate portions extending in a horizontal direction perpendicular to the insertion direction from the first vertical side plate portions, the horizontal side plate portions abut an edge portion of the circuit board in the assembled position; and a pair of second vertical side plate portions extending in the insertion direction from the horizontal side plate portions; and a top cover attached to an outer wall of the cage and having a plurality of pins, the pins inserted in the insertion direction into the insertion holes in the assembled position.

* * * * *